US012582286B2

(12) United States Patent
Bauer et al.

(10) Patent No.: US 12,582,286 B2
(45) Date of Patent: Mar. 24, 2026

(54) DOMESTIC CLEANING MACHINE

(71) Applicant: emz-Hanauer GmbH & Co. KGaA, Nabburg (DE)

(72) Inventors: Matthias Bauer, Schmidgaden (DE); Johann Kleber, Nabburg (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 70 days.

(21) Appl. No.: 18/611,881

(22) Filed: Mar. 21, 2024

(65) Prior Publication Data

US 2024/0315526 A1 Sep. 26, 2024

(30) Foreign Application Priority Data

Mar. 22, 2023 (DE) ..... 102023107240.4

(51) Int. Cl.
*A47L 15/42* (2006.01)
*A47L 15/44* (2006.01)

(52) U.S. Cl.
CPC ..... *A47L 15/449* (2013.01); *A47L 15/4214* (2013.01); *A47L 15/4246* (2013.01); *A47L 15/4251* (2013.01); *A47L 15/44* (2013.01)

(58) Field of Classification Search
None
See application file for complete search history.

(56) References Cited

U.S. PATENT DOCUMENTS

2014/0060597 A1* 3/2014 Welch ..... A47L 15/4246 134/107

FOREIGN PATENT DOCUMENTS

DE 202008007298 U1 8/2008
EP 3831269 A1 6/2021

* cited by examiner

*Primary Examiner* — Levon J Shahinian
(74) *Attorney, Agent, or Firm* — Tarolli, Sundheim, Covell & Tummino LLP

(57) ABSTRACT

The invention relates to a domestic cleaning machine, in particular a built-in domestic cleaning machine, comprising a cleaning machine body and a cleaning machine door connected thereto for closing the domestic cleaning machine, wherein a main tub for holding objects to be cleaned and flushing liquid is provided in the cleaning machine body, and wherein a sump and a salt compartment are arranged below a bottom of the main tub, and wherein a detergent compartment, which is designed to hold detergent, is additionally provided, and wherein a water cycle is provided for supplying water for a wash cycle of the domestic cleaning machine. According to the invention, it is provided that the detergent compartment is also arranged below the bottom of the main tub.

11 Claims, 3 Drawing Sheets

State of the art

State of the art

State of the art

DOMESTIC CLEANING MACHINE

CROSS-REFERENCE TO RELATED APPLICATIONS

This patent application claims the benefit of and priority to German Patent Application No. 102023107240.4, filed on Mar. 22, 2023, which is herein incorporated by reference in its entirety.

FIELD OF THE DISCLOSURE

The invention relates to a domestic cleaning machine, in particular a built-in domestic cleaning machine.

SUMMARY

The invention relates to a domestic cleaning machine, in particular a built-in domestic cleaning machine, comprising a cleaning machine body and a cleaning machine door connected thereto for closing the domestic cleaning machine, wherein a main tub for holding objects to be cleaned and flushing liquid is provided in the cleaning machine body, and wherein a sump and a salt compartment are arranged below a bottom of the main tub, and wherein a detergent compartment, which is designed to hold detergent, is additionally provided, and wherein a water cycle is provided for supplying water for a wash cycle of the domestic cleaning machine.

The domestic cleaning machines according to the state of the art are designed in such a way that the detergent compartment is integrated on or in the door, where it can usually be filled by hand. Such a detergent compartment located in the door has the disadvantage that the installation space provided by the door is limited and only a small detergent compartment can be realised, so that the detergent often has to be refilled. Another factor that limits the size of the detergent compartment is the number of items to be cleaned, in particular the number of place settings that can be placed in the main tub. The intention is, to be able to place as many whole place settings as possible in the main tub.

In addition, the arrangement of the detergent in the cleaning machine door can result in the movement behaviour of the door changing when the cleaning machine door is closed or opened due to the changing mass of detergent, which can have a negative effect on the user's handling of the cleaning machine.

This invention has for its object to provide a domestic cleaning machine by means of which the disadvantages of the prior art can be overcome.

The problem is solved by a domestic cleaning machine according to claim 1. The subclaims comprise preferred embodiments.

The invention provides a domestic cleaning machine, in particular a built-in domestic cleaning machine, comprising a cleaning machine body and a cleaning machine door connected thereto for closing the domestic cleaning machine, wherein a main tub for holding objects to be cleaned and flushing liquid is provided in the cleaning machine body, and wherein a sump and a salt compartment are arranged below a bottom of the main tub, and wherein a detergent compartment, which is designed to hold detergent, is additionally provided, and wherein a water cycle is provided for supplying water for a wash cycle of the domestic cleaning machine, wherein the detergent compartment is also arranged below the bottom of the main tub.

The term "domestic cleaning machine" can be understood to mean any household appliance which comprises the said features according to the state of the art as defined in the generic term of claim 1. A domestic cleaning machine can therefore be a dishwasher for holding dishes to be cleaned, or a washing machine for holding laundry to be cleaned, and the like. Preferably, the domestic cleaning machine is a dishwasher.

The term "built-in domestic cleaning machine" refers to a domestic cleaning machine that can be installed in a given installation space, for example in a kitchen unit, fully integrated, partially integrated or as a substructure. The dimensions are predetermined for the domestic cleaning machine and limited by the installation space the domestic cleaning machine can be build in.

The term "water cycle" is to be understood here in such a way, that several water-bearing and/or water-receiving and/or water-connected components can be provided, such as a water tank, the sump, the salt compartment, the main tub, connecting lines, valves, pumps, the detergent compartment and the like.

A "wash cycle" is understood here to mean running through a cleaning programme by means of which the objects to be cleaned, are to be cleaned.

According to the invention, it is now provided that the detergent compartment is arranged below the bottom of the main tub. By "below" it is to be understood that a height axis is provided, and wherein the respective component can be arranged along this height axis below the other component. Similarly, "below" can also be understood to mean directly below, meaning that the component is arranged directly below the main tub, or in other words that the main tub and the component overlap at least partially or completely when viewed along the height axis.

By arranging the detergent compartment in an area of the domestic cleaning machine in which there is still a relatively large amount of installation space available, as the sump and salt compartment are located there, a considerably larger detergent compartment can be provided compared to the previous detergent compartment, which is located in the cleaning machine door, which can hold significantly more detergent, thereby reducing the frequency with which detergent needs to be refilled.

It can also be achieved that the cleaning machine door can be opened and closed constantly and consistently, as the detergent is no longer located in the door and the mass distribution of the cleaning machine door is influenced by the removal of detergent.

According to a particularly preferred embodiment, it can be provided that the cleaning machine door is free of detergent compartments. The fact that detergent is no longer arranged or prescribed in the cleaning machine door means that a constant mass distribution of the cleaning machine door can be achieved; a variation in the mass due to removal or filling with detergent is avoided. This leads in particular to a constant and continuous dishwasher door movement.

According to a further preferred embodiment, it may be provided that the detergent compartment is designed to hold a liquid, gel-like or powder-like detergent. Depending on the type of dishwasher, the detergent compartment can be adapted to the desired or required detergent. This also applies to the way in which the detergent can be introduced into the water cycle.

According to a preferred embodiment, a dosing and feeding device can be provided, which is intended and designed to dose detergent from the detergent compartment and feed it to the main tub. By dosing by means of the dosing and feeding device, a certain amount of detergent can be provided, which is added to the water cycle and can then be used as a flushing liquid for cleaning the objects to be cleaned in the main tub.

According to a preferred embodiment, it may be provided that the dosing and feeding device is integrated into the water cycle in such a way that the detergent can be added to the water cycle by means of the dosing and feeding device.

If the detergent is liquid or gel-like, it can be easily dosed using existing pumps and/or valves. If the detergent is to be in powder form, the dosing and feeding device is designed in such a way that the detergent can be added to the water cycle by means of an injection. For this purpose, a dispenser into which a dosed amount of detergent can be added and flushed into the water cycle can preferably be provided.

According to a further preferred embodiment, it may be provided that a filler opening is provided for filling the detergent compartment, wherein the filler opening is arranged in the bottom of the main tub, wherein cumulatively or alternatively the filler opening may be arranged in a wall of the main tub, and further alternatively or cumulatively may be arranged in the cleaning machine door. Detergent can be introduced into the detergent compartment by means of the filler opening.

If the filler opening is located in the bottom of the main tub, filling is similarly simple and convenient as filling the salt compartment. The same applies to the arrangement of the filler opening in the wall of the main tub. If the filler opening is arranged in the cleaning machine door, the filling process is similar and convenient to that of the prior art, although no detergent remains in the cleaning machine door, but can be transported to the detergent compartment below the main tub. Regardless of the variant, the detergent can be transported from the filler opening into the detergent compartment by pipes or the like.

According to a particularly preferred embodiment, it may be provided that the detergent compartment and the salt compartment are designed with respect to each other in such a way that a provision period of detergent essentially corresponds to a provision period of salt.

In this context, a provision period means that the respective agent can be removed from the respective associated compartment until the compartment is emptied. Preferably, the provision period is given by a time of a completely or almost completely filled state of the respective compartment up to the time or state at which the compartment is emptied.

The term "essentially" is to be understood in such a way that the provision periods differ by a maximum of 10%, preferably by a maximum of 5% and even more preferably by a maximum of 2%.

According to the embodiment, it is accordingly provided that the compartments are emptied at a similar speed, so that the detergent compartment and the salt compartment have to be refilled at approximately the same time. This can enable user-friendly handling during filling, as any racks that hold the objects to be cleaned only and that need to be removed, need to be removed once, so that the filler openings of the detergent compartment and the salt compartment are accessible, especially if the filler opening is arranged in the bottom of the main tub or in the wall of the main tub. However, time can also be saved if the filler opening is located in the cleaning machine door.

According to a further preferred embodiment, the detergent compartment is arranged in a fixed position in the domestic cleaning machine because the lower section of the domestic dishwasher, particularly when installed in a kitchen unit or the like, is covered with a panel for improved visual integrity. Accordingly, the detergent compartment cannot be removed from the domestic dishwasher for filling, as this is prevented by the panel of the domestic cleaning machine in its lower area. The lower area is preferably the area below the cleaning machine door.

Detergent compartments which can be inserted into and removed from the domestic cleaning machine from the outside, for example like cartridges, are therefore not provided according to the present invention.

Further preferably, the detergent compartment is fixedly connected to elements of the domestic cleaning machine, for example to the cleaning machine body and/or to the bottom of the main tub. However, it is envisaged that the fixed connection of the detergent compartment to the corresponding component or components is a detachable connection, so that in the event of damage, for example leakage or the like, the detergent compartment can be removed from the domestic cleaning machine and replaced by a functional detergent compartment.

Further advantages, objectives and features of the present invention are explained with reference to the following description of the attached figures. Similar components may have the same reference signs in the various embodiments.

In the figures, identical components are marked with the corresponding reference signs. For the sake of clarity, components may not be labelled with a reference sign in some figures but have been designated elsewhere.

DETAILED DESCRIPTION

Figure 1A:
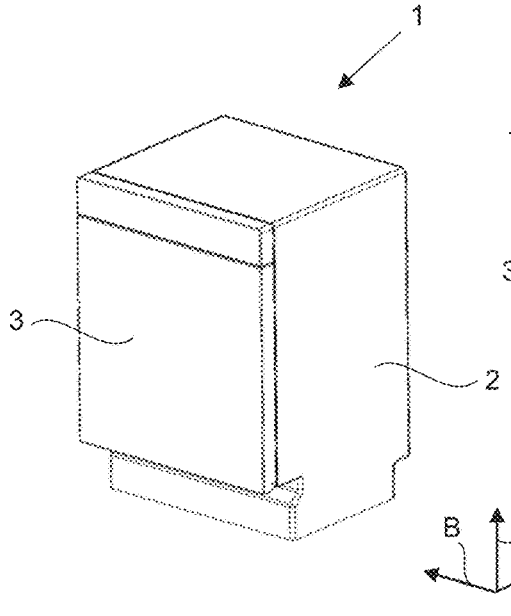
FIG. 1A perspective view of a domestic cleaning machine according to the state of the art.
Figure 1B:
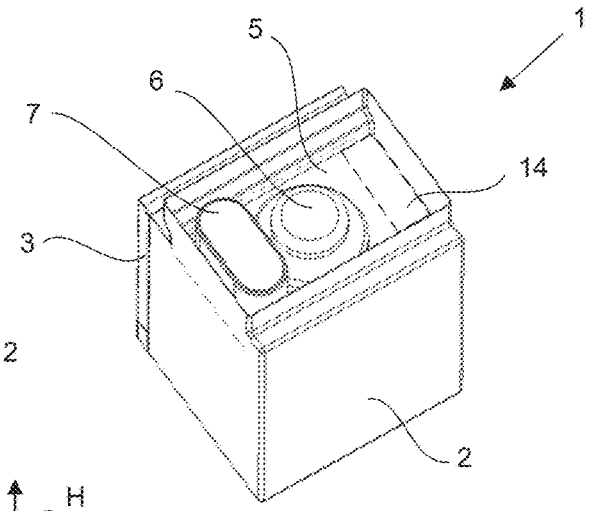
FIG. 1B bottom view of the domestic cleaning machine shown in FIG. 1A.

FIGS. 1A, 1B and IC show a domestic cleaning machine 1 comprising a cleaning machine body 2 and a cleaning machine door 3 connected thereto. FIG. 1B shows a bottom view of the domestic cleaning machine 1 according to FIG. 1A, whereby a lid that closes the cleaning machine body 2 to the outside has been omitted. It can be seen that the domestic cleaning machine 1 according to the prior art comprises a salt compartment 7 for holding salt or regeneration salt and a sump 6, wherein the salt compartment 7 and the sump 6 are arranged below a bottom of the main tub 5, as seen along a height axis H, wherein a main tub 4 is arranged inside the cleaning machine body 2 and is designed to hold objects to be cleaned. Also indicated is a free installation space or available space 14, which represents a volume in which no components of the domestic cleaning machine 1 are arranged.

Figure 1C:
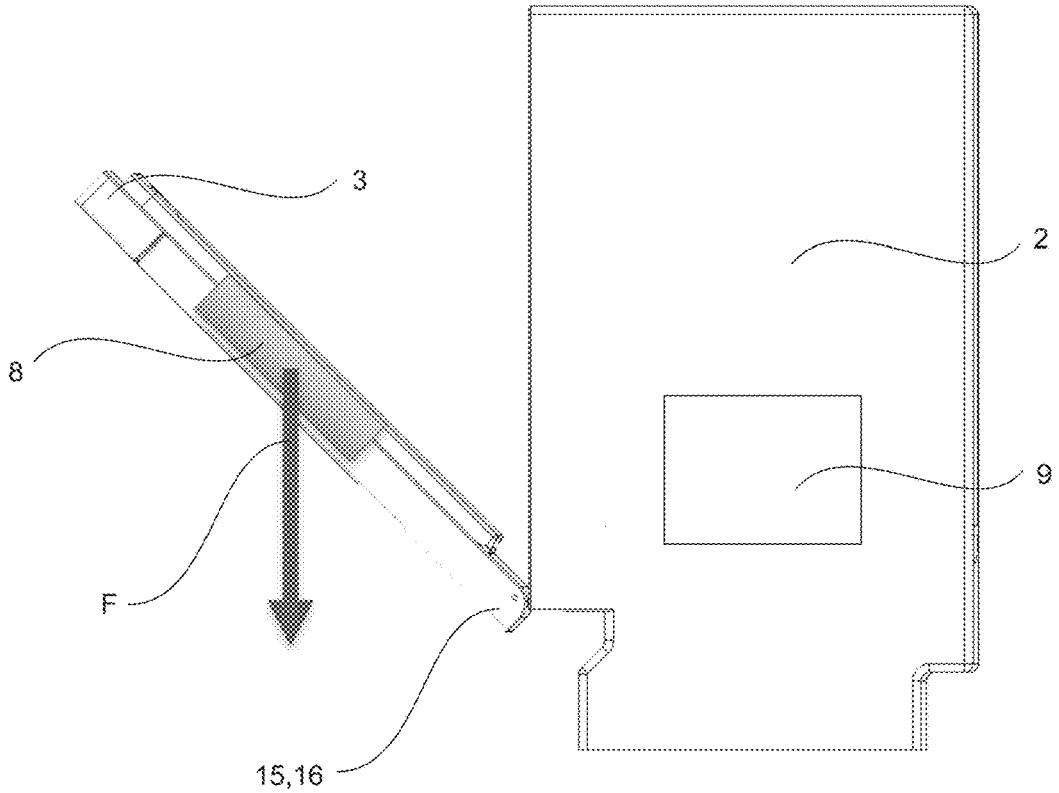
FIG. 1C the domestic cleaning machine shown in FIG. 1A in a side view with an open cleaning machine door.

FIG. 1C shows a side view of the domestic cleaning machine 1 as shown in FIG. 1A, with an open cleaning machine door 3. An existing water cycle 9 is indicated purely schematically.

The cleaning machine door 3 is connected to the cleaning machine body 2 so that it can rotate about an axis of rotation 15, the axis of rotation 15 being formed by a cleaning machine door hinge 16.

Furthermore, the domestic cleaning machine 1 comprises a detergent compartment 8, which is arranged in the cleaning machine door 3. Filling and removing detergent from the detergent compartment 8 causes a force F to change, which is altered by the remaining mass of detergent in the detergent compartment 8. Accordingly, the mass distribution changes with regard to the cleaning machine door 3, as do the torques that result from the rotatable design of the cleaning machine door 3.

The changes in the force F and the acting torques change the sense of closing and opening for a person operating the cleaning machine door 3 to close or open the domestic cleaning machine 1.

Likewise, the detergent compartment 8 is relatively small due to its arrangement in the cleaning machine door 3, so that relatively frequent refilling of detergent is necessary.

Figure 2:
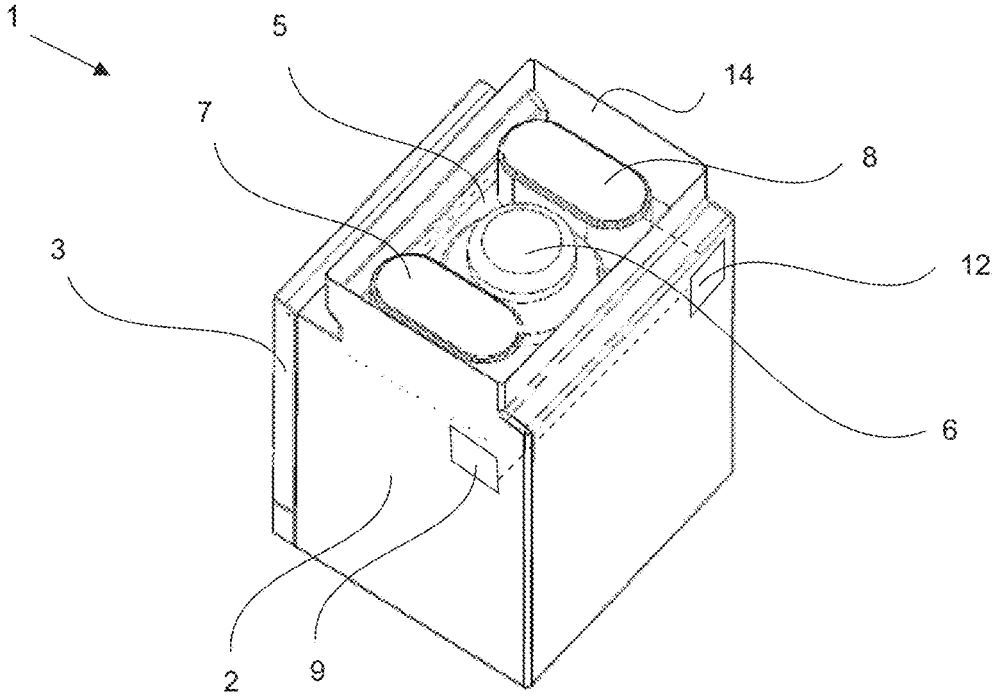
FIG. 2 bottom view of a domestic cleaning machine according to a preferred embodiment.

FIG. 2 shows a bottom view of a domestic cleaning machine 1 according to the invention, which can overcome the disadvantages of the prior art described above.

For this purpose, the domestic cleaning machine 1 according to FIG. 2 also comprises a cleaning machine body 2, a cleaning machine door 3 and a sump 6 as well as a salt compartment 7, the arrangement and design of which can be as in the prior art according to FIGS. 1A to IC.

According to the invention, however, it is now provided that a detergent compartment 8 is now also arranged below the bottom of the main tub 5, and preferably arranged in the available space 14 of the domestic cleaning machine 1.

Accordingly, the cleaning machine door 3 is now free of detergent compartments 8, thus overcoming the disadvantages of the prior art.

The water cycle 9 is also indicated again purely schematically. Furthermore, the domestic cleaning machine 1 comprises a dosing and feeding device 12, which is integrated into the water cycle 9 or connected to the water cycle 9, so that detergent can be added to the water cycle 9 by means of the dosing and feeding device 12 or detergent can be added to the water of the water cycle 9. Connections are shown schematically with dashed lines.

As can be seen, the salt compartment 7 and the detergent compartment 8 are relatively similar in terms of the amount of the respective agents they can hold. More specifically, the salt compartment 7 and the detergent compartment 8 are designed in such a way that a provision period of detergent essentially corresponds to a provision period of salt. The respective provision period means that agent can be removed from the respective container 7, 8 until it is emptied. Particularly preferably, the provision period refers to the period between a completely filled state and an empty state. Because the provision periods of the containers 7, 8 are essentially the same in relation to each other, both containers 7, 8 can be filled in the same process, so that racks that place the objects to be cleaned inside the main tub 4 only have to be removed once, which makes things easier for the user.

By changing the position of the detergent compartment 8, it is also possible to consider varying a filler opening 10 of the detergent compartment 8 for filling the detergent compartment 8.

Figure 3A:
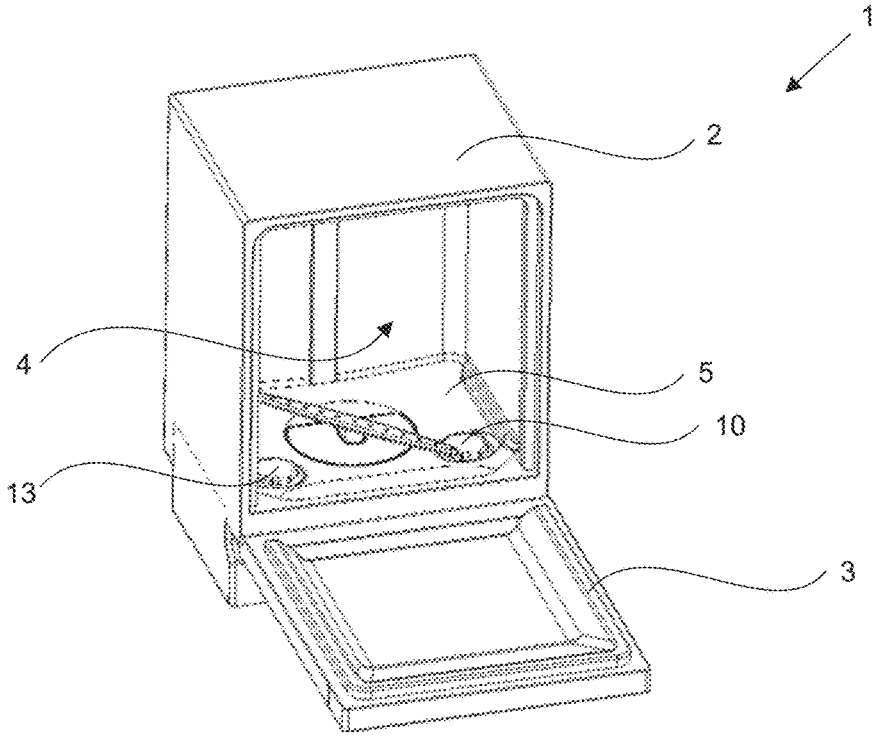
FIG. 3A the domestic cleaning machine shown in FIG. 2 with the cleaning machine door open in a preferred embodiment.
Figure 3B:
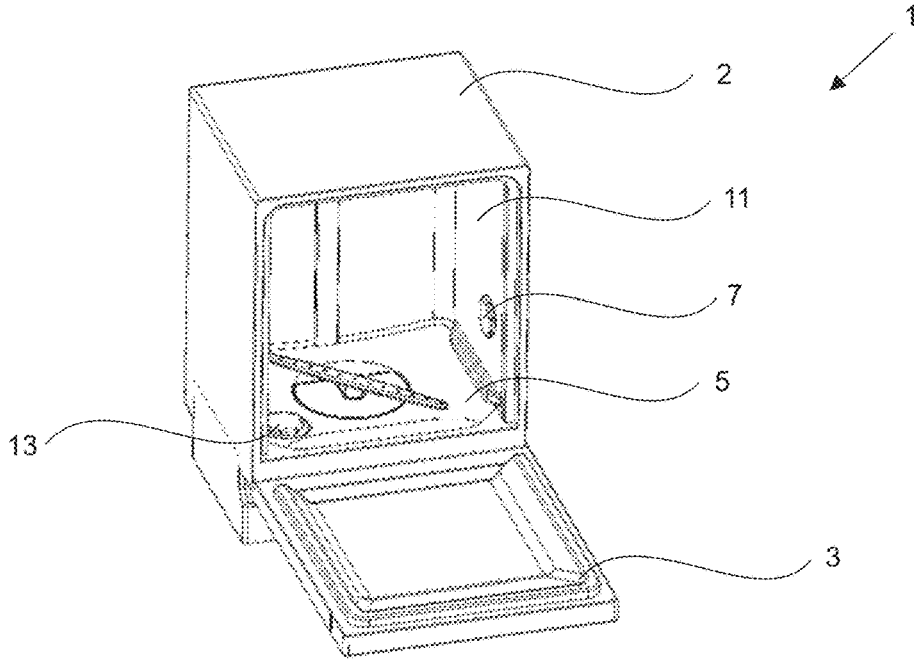
FIG. 3B the domestic cleaning machine shown in FIG. 2 with the cleaning machine door open in another preferred embodiment.
Figure 3C:
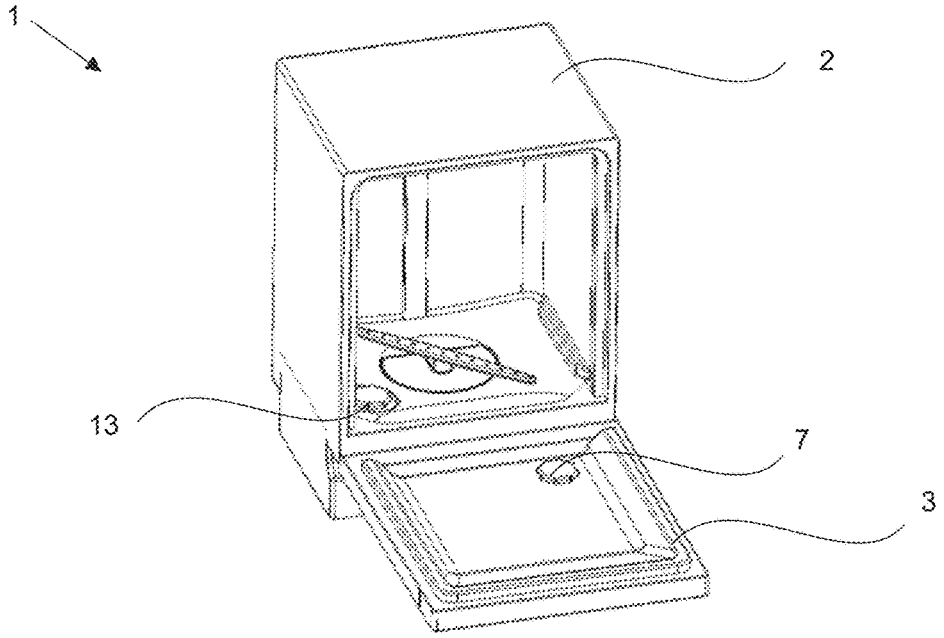
FIG. 3C the domestic cleaning machine shown in FIG. 2 with the cleaning machine door open in another preferred embodiment.

FIGS. 3A, 3B and 3C show various possible arrangements for the filler opening 10 of the detergent compartment 8. In principle, the filler opening 10 of the detergent compartment 8 is provided in the main tub 4. The filler opening 10 of the detergent compartment 8 is also designed to be closable.

According to the embodiment shown in FIG. 3A, the filler opening 10 of the detergent compartment 8 is arranged in the bottom of the main tub 5, similar to the filler opening 13 of the salt compartment 7.

According to the embodiment shown in FIG. 3B, the filler opening 10 of the detergent compartment 8 is arranged in a wall of the main tub 11.

According to the embodiment shown in FIG. 3C, the filler opening 10 of the detergent compartment 8 is arranged in the cleaning machine door 3. Particularly preferably, the filler opening according to FIG. 3C is preferably arranged in a lower region of the cleaning machine door 3, so that the influence on the cleaning machine door 3 due to possibly unintentional overfilling of the detergent compartment 8, which results in detergent being present up to the filler opening 10, can be reduced by removing the detergent. The influence of the resulting torque is reduced by the fact that the lever between the axis of rotation 15 and the filler opening 13 of the salt compartment 7 is kept as small as possible.

Preferably, the filler opening 10 of the detergent compartment 8 is arranged above the detergent compartment 8, as seen along the height axis H, so that the detergent runs or falls downwards by means of gravity and is introduced into the detergent compartment 8.

A fill level indicator is particularly preferably provided, by means of which a fill level of the detergent compartment 8 can be displayed.

The applicant reserves the right to claim all features disclosed in the application documents as being essential to the invention, provided that they are new compared to the prior art, either individually or in combination. It should also be noted that the individual figures also describe features which may be advantageous in themselves. The skilled person immediately recognises that a particular feature described in a figure can also be advantageous without the adoption of further features from this figure. Furthermore, the skilled person recognises that advantages can also result from a combination of several features shown in individual figures or in different figures.

LIST OF REFERENCE SYMBOLS

1 Domestic cleaning machine
2 Cleaning machine body
3 Cleaning machine door
4 Main tub
5 Bottom of the main tub
6 Sump
7 Salt compartment
8 Detergent compartment
9 Water cycle
10 Filler opening of the detergent compartment
11 Wall of the main tub
12 Dosing and feeding device
13 Filler opening of the salt compartment
14 Available space
15 Axis of rotation

16 Door hinge
F Force
H Height axis
L Length axis
B Width axis

What is claimed is:

1. A domestic cleaning machine comprising a cleaning machine body and a cleaning machine door connected thereto for closing the domestic cleaning machine, wherein a main tub for receiving objects to be cleaned and flushing liquid is provided in the cleaning machine body, wherein a sump and a salt compartment are arranged below a bottom of the main tub, wherein a detergent compartment, which is designed to hold detergent, is additionally provided, and wherein a water cycle is provided to provide water for a wash cycle of the domestic cleaning machine, characterized in that the detergent compartment is also arranged below the bottom of the main tub, and wherein a dosing and feeding device is provided, which is intended and designed to dose detergent from the detergent compartment and to feed it to the main tub, wherein the dosing and feeding device is integrated into the water cycle in such a way that the detergent can be directly added to the water cycle by means of the dosing and feeding device.

2. The domestic cleaning machine according to claim 1, characterized in that the cleaning machine door is free of detergent compartments.

3. The domestic cleaning machine according to claim 1, characterized in that the detergent compartment is designed to hold a liquid, gel-like, or powder-like detergent.

4. The domestic cleaning machine according to claim 1, characterized in that a filler opening is provided for filling the detergent compartment, wherein the filler opening is arranged in the bottom of the main tub.

5. The domestic cleaning machine according to claim 1, characterized in that the detergent compartment and the salt compartment are designed relative to one another in such a way that a provision period of detergent essentially corresponds to a provision period of salt.

6. The domestic cleaning machine according to claim 1, characterized in that the detergent compartment is arranged in a fixed position in the domestic cleaning machine.

7. The domestic cleaning machine according to claim 1, characterized in that a liquid or gel-like detergent is dosed via existing pumps and/or valves, wherein a detergent in powder form is injected into the water cycle.

8. The domestic cleaning machine according to claim 1, characterized in that a filler opening is provided for filling the detergent compartment and that the filler opening is arranged in a wall of the main tub.

9. The domestic cleaning machine according to claim 1, characterized in that a filler opening is provided for filling the detergent compartment and that the filler opening is arranged in the cleaning machine door.

10. The domestic cleaning machine according to claim 1, wherein the detergent compartment (8) is designed to hold a liquid, gel-like or powder-like detergent, wherein a filler opening (10) is provided for filling the detergent compartment (8), wherein the filler opening (10) is arranged in the bottom of the main tub (5), wherein the detergent compartment (8) and the salt compartment (7) are designed relative to one another in such a way that a provision period of detergent essentially corresponds to a provision period of salt.

11. A domestic cleaning machine comprising:

a cleaning machine body;

a main tub provided in the cleaning machine body for receiving objects to be cleaned and flushing liquid;

a cleaning machine door connected to the cleaning machine body for closing the domestic cleaning machine;

a sump and a salt compartment arranged below a bottom of the main tub, a detergent compartment arranged below the bottom of the main tub for holding detergent;

a dosing and feeding device for dosing detergent from the detergent compartment and delivering the detergent to the main tub; and a water cycle for providing water for a wash cycle of the domestic cleaning machine, wherein the dosing and feeding device is integrated into the water cycle in such a way that the detergent can be directly added to the water cycle by the dosing and feeding device.

* * * * *